United States Patent [19]

Burns

[11] 4,421,436

[45] Dec. 20, 1983

[54] TENSION LEG PLATFORM SYSTEM

[75] Inventor: Robert B. Burns, Huntington, N.Y.

[73] Assignee: Texaco Development Corporation, White Plains, N.Y.

[21] Appl. No.: 395,385

[22] Filed: Jul. 6, 1982

[51] Int. Cl.[3] ..... E02B 15/04

[52] U.S. Cl. ..... 405/60; 405/195; 405/224

[58] Field of Search ..... 405/60, 210, 224–227, 405/195–209, 52, 53; 210/922, 923; 114/264, 265; 166/356, 357; 175/5, 7

[56] References Cited

U.S. PATENT DOCUMENTS

| | | | |
|---|---|---|---|
| 3,389,559 | 6/1968 | Logan | 405/60 |
| 3,477,236 | 11/1969 | Burrus | 405/204 |
| 3,548,605 | 12/1970 | Paull et al. | 405/60 |
| 3,599,434 | 8/1971 | Missud | 405/60 |
| 3,664,136 | 5/1972 | Laval et al. | 405/60 |
| 3,667,605 | 6/1972 | Zielinski | 405/60 |
| 3,717,001 | 2/1973 | Tam | 405/224 X |
| 3,745,773 | 7/1973 | Cunningham | 405/60 |
| 4,169,424 | 10/1979 | Newby et al. | 405/224 X |
| 4,258,794 | 3/1981 | Sizey et al. | 166/356 |
| 4,273,472 | 6/1981 | Piazza et al. | 166/356 X |

*Primary Examiner*—Dennis L. Taylor

*Attorney, Agent, or Firm*—Robert A. Kulason; Robert Knox, Jr.; Robert B. Burns

[57] ABSTRACT

A tension leg platform system for use in drilling wellbores into the floor of an offshore body of water. Includes in the system is a buoyancy control vessel having a plurality of pull down cables attached thereto which extend to the ocean floor. A plurality of spaced apart anchors disposed at the ocean floor are positioned to receive the lower ends of the respective pull down cables. A submergible hull slidably engages the respective hold down cables such that the hull can be controllably lowered to the ocean floor whereby a canopy carried on the hull will cover an uncontrollably flowing well to conduct the effluent to the water's surface.

12 Claims, 7 Drawing Figures

FIG. 3
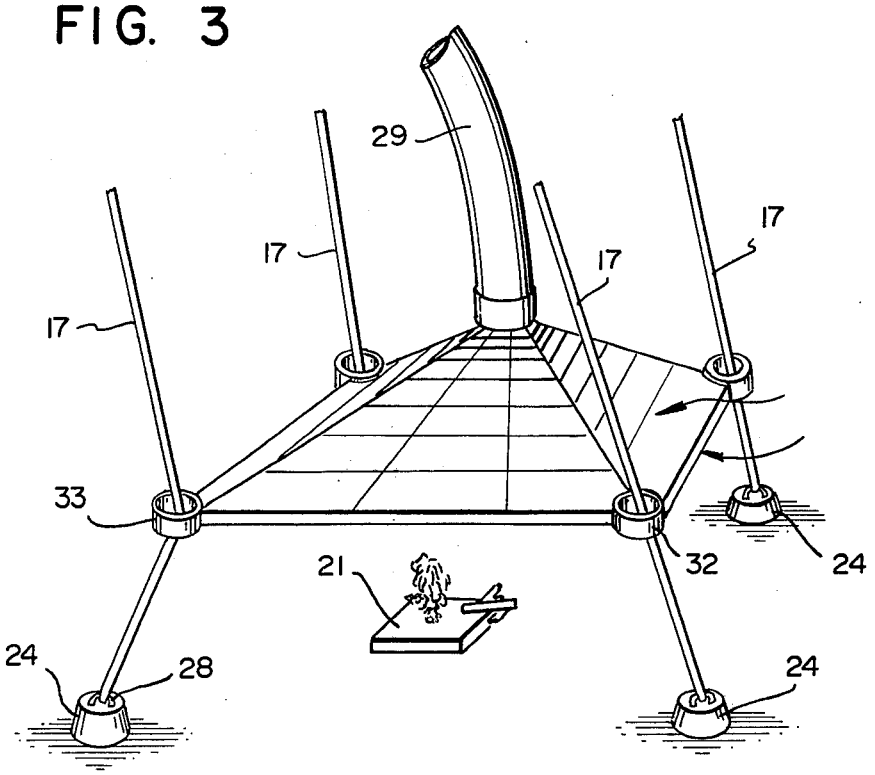
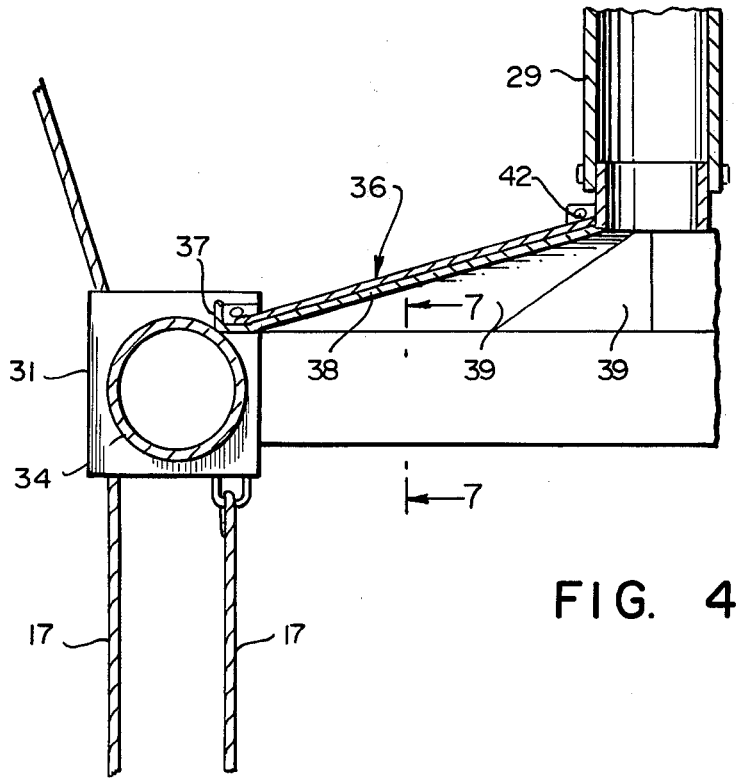
FIG. 4

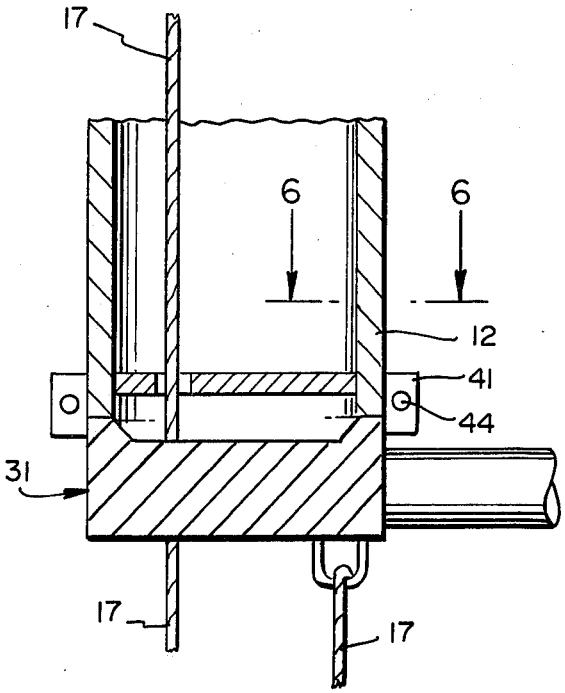
FIG. 5
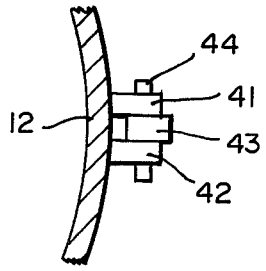
FIG. 6
FIG. 7
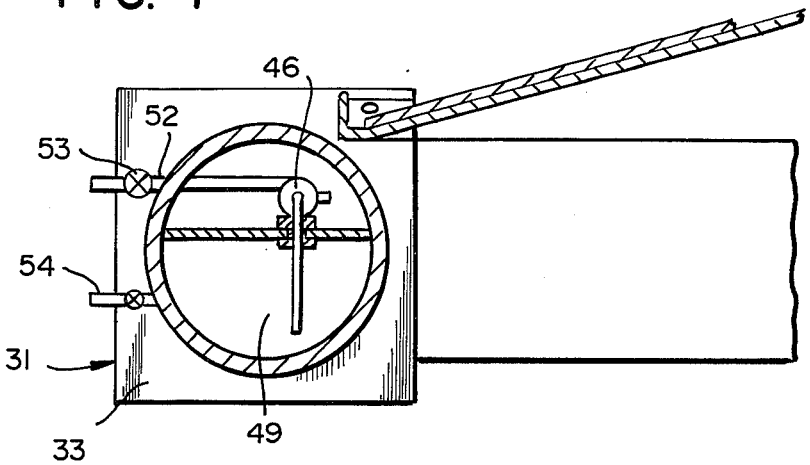

TENSION LEG PLATFORM SYSTEM

BACKGROUND OF THE INVENTION

Technological and environmental problems have persistently arisen as the quest for crude oil and gas becomes more and more acute. Further, it has become necessary to go further offshore in search of adequate production areas. However, the further offshore that one goes, the deeper the water will be.

As a consequence, wellbores are being drilled regularly in greater than one thousand feet of water. While much technology is available regarding the safe and controlled drilling of offshore wells, the problems which arise in conjunction with the deeper waters are becoming increasingly complex.

Further, with the greater depths of water in which it becomes necessary to drill, fixed platforms utilized for producing such wells involves enormous costs. It thus reduces to a question of; is the prospective crude oil-containing reservoir beneath the ocean floor sufficiently abundant to warrant the use of an expensive deep water drilling and/or producing platforms.

Within the past several years, considerable research and development work has been done toward the production of a usable tension leg platform system. In the latter type unit, the basic component comprises a floatable vessel which is capable of adjusting its buoyancy at the water's surface.

A plurality of anchors which have previously been positioned at the ocean floor, are connected to the buoyant vessel by a plurality of holding or pull down cables. It is thus possible, by adjusting the tension on the cables, to position the floating vessel above an area in which a well is to be drilled.

The floating vessel will usually be displaced from directly above a drilling site by surface conditions such as wind and waves, as well as by underwater currents. It is nonetheless possible through the use of supported risers or the like to accomplish drilling operations at great water depths through this type of platform.

A problem which is always present when operating in deep offshore waters, is the possibility that the well or wells being drilled can at any time become uncontrolled or blown out and flow without restraint. This situation has occurred in the past and frequently results in loss of equipment due to damage and/or fire. It also results in the loss of the crude product and the gas both of which flow rapidly to the water's surface.

With the added risk involved in drilling wells in deep waters, it is conceivable that even a minor leak at the ocean floor would permit an uncontrolled and disastrous flow of oil and gas. Such a situation would not only result in the loss of the oil, but could constitute a safety hazard to the immediate environment.

To overcome the above-identified problems and difficulties which are endemic to drilling in deep offshore waters, the present invention is provided. In the later, a drilling vessel having a floatable hull is positioned at the water's surface upwardly, from a well site. Hold down, variable tension cables operably connect to the vessel and extend downwardly to the ocean floor. At the latter the cables are connected to a plurality of prepositioned anchors.

A submergible hull is provided which includes means to removably engage the respective hold down cables. Thus, in the event that an uncontrollably flowing well is encountered, the submergible vessel can be slidably engaged with the hold down cables and controllably lowered to the ocean floor. The submergible hull is provided with a closure member such that upwardly flowing and expanding fluids can be received, and conducted in a controlled manner to the water's surface where they will be collected.

It is therefore an object of the invention to provide an offshore well drilling system which is capable of quickly and effectively confining the effluent from an uncontrollably flowing well. A further object is to provide a tension leg platform system having a detachably positioned submergible portion that can be controllably lowered to the ocean floor by way of the platform's hold down cables.

DESCRIPTION OF THE DRAWINGS

FIG. 3 is a segmentary view showing the canopy in place above a well. FIG. 4 is an enlarged segmentary view of a canopy unit. FIG. 5 is a sectional view on an enlarged scale taken along line 5—5 in FIG. 1. FIG. 6 is a segmentary view taken along line 6—6 in FIG. 5. FIG. 7 is similar to FIG. 4.

Figure 1:
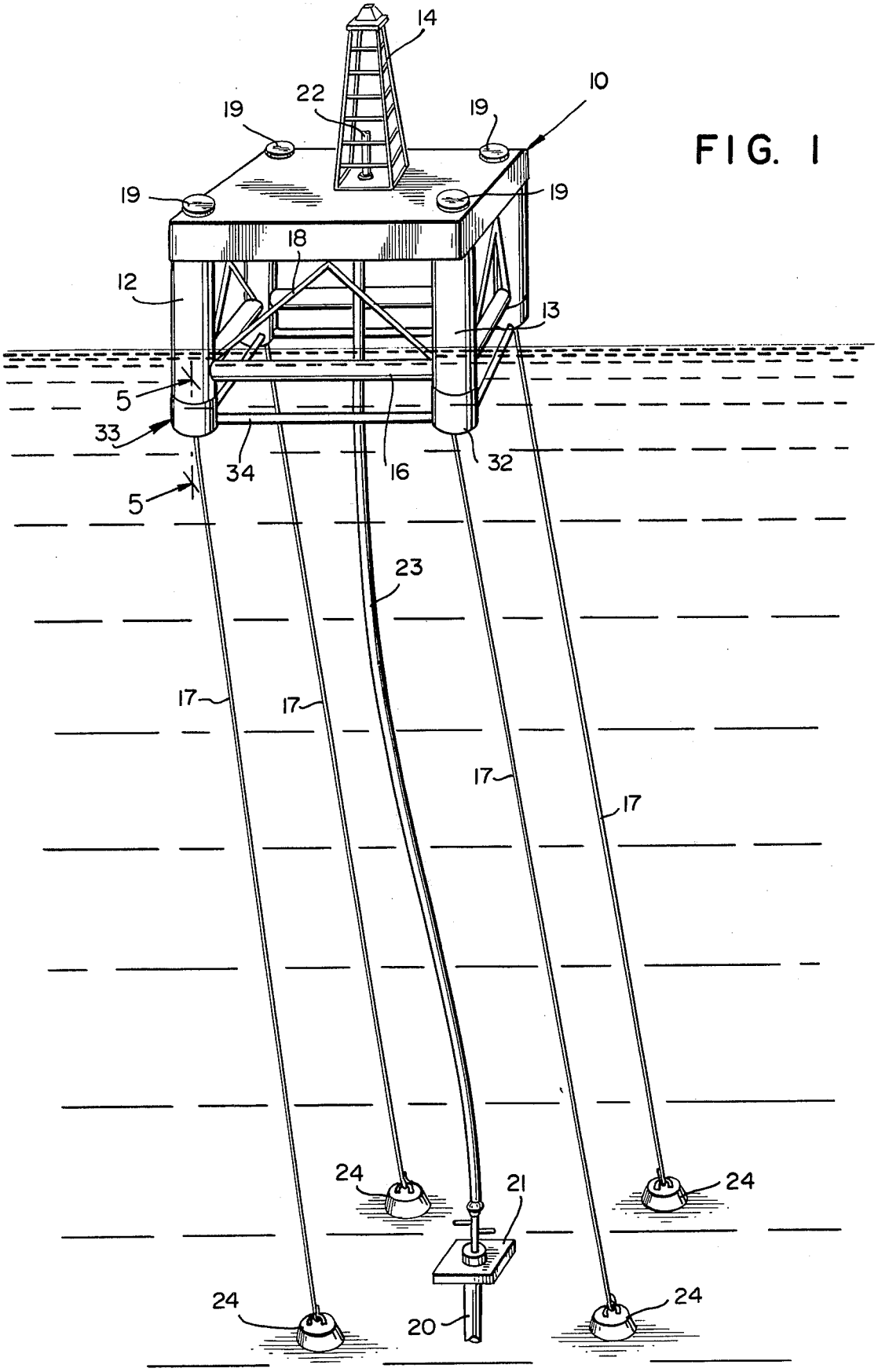
FIG. 1 illustrates a system of the type contemplated in which a marine vessel is positioned by a series of downwardly extending cables.
Figure 2:
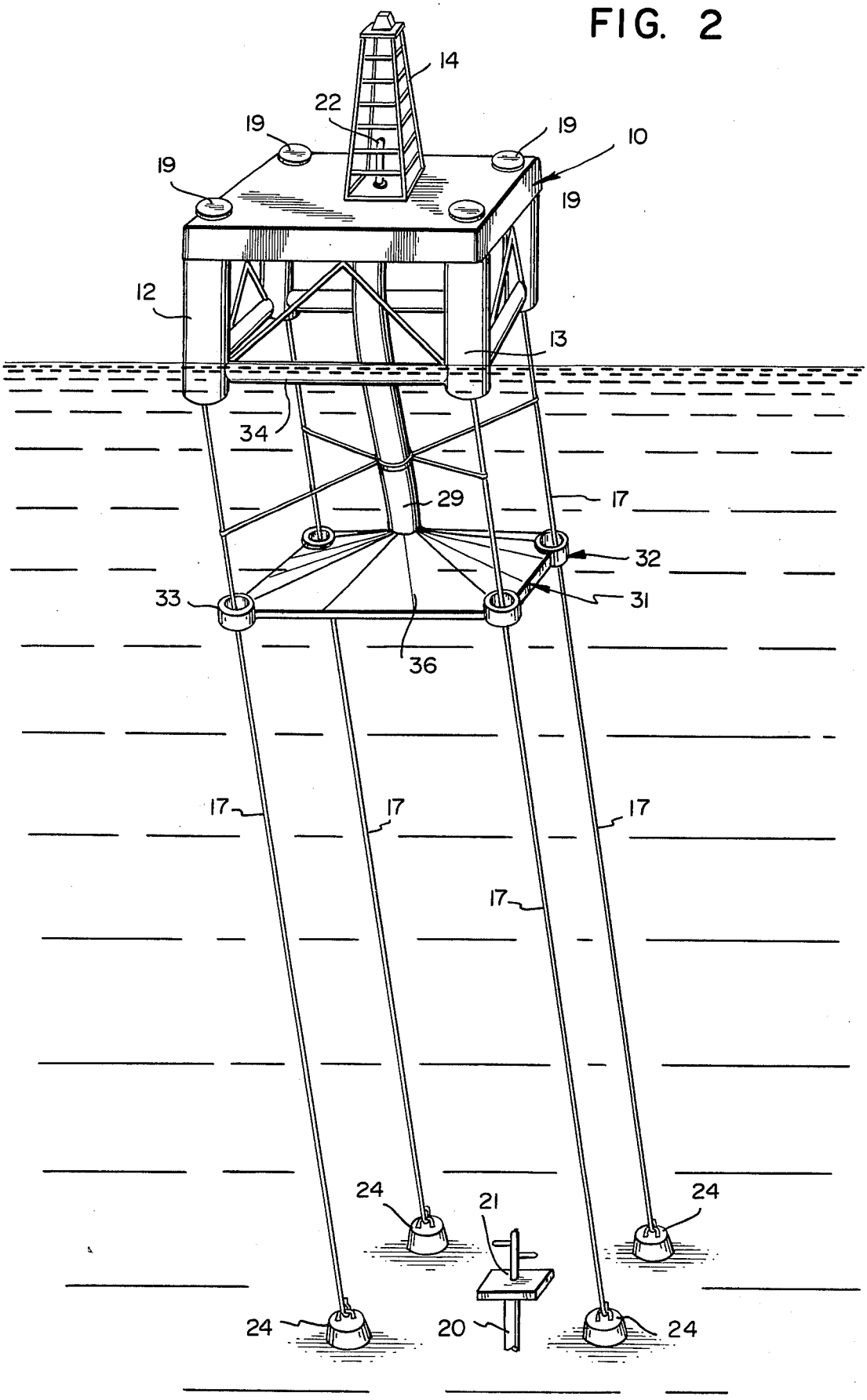
FIG. 2 is similar to FIG. 1, showing an effluent collecting canopy being lowered to the ocean floor.

Referring to the drawings, the present system is shown as embodying a tension leg marine vessel or platform 10 which is comprised of a deck 11 from which a plurality of support legs 12 and 13 downwardly depend. It is understood that the floating, or tension leg vessel is but one, albeit necessary element in the overall system. A single or multi-hull drilling vessel which utilizes the tension leg principle, can be adapted to the present system so long as it employes means to engage the various tension cables which maintain it in position above a drilling site.

Referring to FIG. 1, vessel 10 is comprised primarily of raised deck 11. The latter supports the necessary equipment for achieving a drilling operation. Such equipment normally would be in the form of a derrick 14, together with the usual drilling pipe storage areas, as well as means to accommodate operating personnel.

Deck 11 is preferably positioned a desired distance above the water's surface normally fifty or more feet to maintain the drilling equipment out of the reach of waves, ocean spray and the like. Thus, each platform 10 is provided as shown with a plurality of legs such as 12 and 13, which are judiciously disposed beneath deck 11 in a manner that they will furnish the necessary buoyancy support.

Each support leg is comprised essentially of an elongated cylindrical member which embodies internal buoyancy tanks. The tanks are in turn connected to pumping means located on deck 11 such that the buoyancy of the unit can be regulated and the deck levelled. Controlled buoyancy vessels of this type are known in the art and have long been utilized in offshore operations.

Cross members 16 interconnect the various legs and are further equipped with tanks to regulate the buoyancy factor.

Thus, depending on the conditions under which platform 10 is operating, the buoyancy can be adjusted through operation of the platform's internal buoyancy control system. For example, when the platform is traveling between working sites, it normally floats under maximum buoyancy conditions at the water's surface. However, when it is located at a drill site the platform will be buoyed to some extent but it will be pulled down into the water counter to the buoyant force by the various hold down cables 17.

To provide for lateral strength, the various support legs 12 and 13 can be provided with non-buoyant, bracing members 18 in a sufficient number to maintain the rigidity of the various legs with respect to deck 11.

A necessary characteristic of this type platform is the power winches 19 which accommodate the various hold down cables 17. Said winches 19 in the present instance are disposed adjacent the respective support legs 12 and 13. The winches are provided in sufficient number to assure that vessel 10 can be maintained at a desired disposition regardless of the condition of the weather at the water's surface.

The primary function of vessel 10 is to be held in position over a desired drilling site at the ocean floor. Thus, and as herein shown, a well 20 and well head 21 are illustrated which embodies the usual blowout preventers and control equipment. Such well heads 21 are normally provided for offshore underwater drilling operations.

In order that drill string 22 might be lowered from derrick 14 to well head 21 to achieve the desired drilling, a riser 23 is provided. The latter extends from deck 11, downward through the water, being attached to the well head 21. Thus, drill string 22, together with its flow of drilling mud, can be directed through riser 23 and into the substrate. The mud is then circulated back up through the riser and to the mud tank on deck 11.

Riser 23 normally comprises relatively heavy walled tubing which is of sufficient diameter to freely accommodate the rotating drill string 22 therein. Further, riser 23 is preferably segmented such that it can be assembled at the drill site. To avoid excessive deformation due to water currents, riser 23 can be provided at different levels with lateral bracing which attaches to hold down cables 17.

Each support leg 12 and 13, is provided with a hold down cable assembly 17 which extends from the cable winching equipment 19 on deck 11, downward to anchor 24. Basically, each cable 17 is connected to an anchor 24 in such manner that when tension is applied to the cables through cable winching mechanism 19, the respective cables will be pulled uniformly tighter and thereby lower vessel 10.

As vessel 10 pulled progressively downward into the water overcoming its own buoyancy by virtue of the tensioned hold down cables, the vessel will become more closely aligned with well head 21 at the ocean floor. However, and as illustrated in the Figures, at greater water depths it is virtually impossible to have the vessel perfectly aligned with well head 21. Ocean currents and the conditions at the water's surface will usually displace vessel 10 and prohibit alignment.

The respective hold down cable assemblies 17, are here illustrated as being a single cable. Said cable, however, can be in the form of a plurality of cables which extend from each anchor and upward to a pulley system at deck 11. In a similar manner, a pulley assembly can be provided at anchors 25 thereby providing the winch mechanism 19 with greater pulling power.

Operationally, and as herein noted, marine vessel 10 is normally floated to a predetermined offshore drilling site either by towing, or under its own power. In the latter instance, the vessel, when of the platform type, will be provided with propulsion units positioned at one or more of the various legs.

At the desired drilling site, anchors 24 which have been, or will be positioned at the ocean floor, are disposed in such manner as to align approximately with the various platform support legs. It is appreciated that such alignment may be inaccurate; however, the pull down function of the cables 17 will nonetheless be effective so long as tension can be applied uniformly to the various legs 12 and 13.

With platform 10 approximately positioned over a drilling site, buoyancy of the respective support legs is adjusted such that the platform will float relatively high in the water. Thereafter, tension is applied to each of the hold down cable assemblies 17 such that the platform will gradually be pulled downward into the water. It will thus be moved more to a vertical position above the various anchors and consequently be fixed above the prospective drilling location.

After well head equipment 21 has been installed, riser 23 will likewise be connected between well head 21 and the platform 10 to receive a lowering drill string 22. The procedure as herein described is standard for tension leg type platforms and will permit the lowering drill string to be guided to the ocean floor and form a wellbore 20.

In accordance with the present invention, platform 10 and cables 17 are arranged to cooperatively function with submergible hull 31. The latter is comprised primarily of a plurality of corner members 32 and 33, each of which is further provided with internal controlled buoyancy tanks. The hull, therefore, constitutes a floatable vessel whose disposition in the water can be controlled.

Submergible hull 31 in one embodiment, provided with means to detachably connect, at least provisionally, to the underside of the respective vertical support legs 12 and 13. It is not only buoyancy controllable, but it is provided with its own system of buoyancy, normally by the expediency of flexible hoses which attach to compressors and pumps on vessel 10 or to equivalent ballasting means. It is thereby possible to control the disposition of the submergible hull 31 remotely from the platform 10.

The basic corner members 32 and 33 of submergible hull 31 are connected through a series of welded structural elements 34 in the form of interconnecting tubular sections. The latter thus define a central, vertical well or passage through hull 31. Elements 34 as herein noted, are provided with internal buoyancy tanks such that they too can be controlled to regulate the disposition of the hull 31 in the water.

Referring to FIGS. 5, 6 and 7, in one embodiment of hull 31, when the latter is held beneath vessel 10, it is fixedly connected to the latter through a detachable engaging means such as pin connectors. Each of the latter include a pair of lugs 41 and 42, which are spaced laterally apart and depend outwardly from the wall of a leg.

At least one tang 43 which depends from corner member 31, registers between the respective lugs. A pin 44 is removably registered within the aligned holes in the corresponding lugs and tank, whereby to fixedly hold the hull 31 against the vessel 10 respective legs until such time as is desired to disconnect the two units.

Buoyancy of hull 31 is controlled from deck 11 of the vessel 10 and functions in response to actuation of a buoyancy pump 44 to unload or offload water. As shown in FIG. 7, hull 31 is provided with at least one pump 46 which can be enclosed within a segregated compartment 47 within the member 34, or can be mounted to the top of the hull.

The suction side of pump 46 is communicated with a tank 48 through a conduit 49 and control valve 51. The pump 46 discharge 52 terminates externally of the hull. Operationally, a control cable 53 which extends from the deck to the pump drive motor, functions to regulate the buoyancy of the hull 31 as needed by ballasting or deballasting the various tanks 48.

While attached to the underside of vessel 10, tanks 48 can be flooded or ballasted by opening the flood valves 52 which are attached to each tank. With water ballast thus taken on, hull 31 can be detached from vessel 10 by removal of the respective connecting pins 44 such that the hull is free to guidably descend to the ocean floor.

When so released, the hull will slide to its place at the well head 21. In contrast, to raise the hull, the pumps 46 are actuated with the valve 52 closed and valve 53 open. The hull will thereby be buoyed to its position at the water's surface to again be attached to the underside of floating vessel 10.

As shown in FIG. 4, submergible hull 31 is provided with means for receiving a canopy 36 which can be positioned to substantially cover the central opening defined by the hull's peripherally arranged structural members. Said canopy support structure in one embodiment is comprised of a ledge 37 formed on member 34 whereby the segmented canopy can be supported on a canopy superstructure 38.

The respective canopy segements 39 are formed of relatively heavy metal and are further supported by upper and lower pinned joints on superstructure 38 such that adjacent segment members are mutually connected and sealed one to the other. They thus provide a desired fluid tight closure across the central opening of hull 31.

Canopy superstructure 38 includes an upper ring 41. The latter supports and retains the segments' upper ends at pinned or similar connection 40.

To assure the fluid tightness of canopy 36 when in position, the latter can be provided with a flexible liner of reinforced rubber or the like disposed about the inner side thereof. Alternately canopy 36 can be provided with a series of sealing strips which extend along the adjacent edges of the canopy segments 39 and which seals are compressed into water tight connections when the canopy segments are assembled.

When not in use, and as shown in FIG. 1, submergible hull 31 is positioned at the underside of a tension leg platform 10 without the canopy 36 in place. However, at such times as it becomes necessary to utilize the hull, the respective canopy segments 39 can be quickly positioned on the submergible hull 31 being supported and pinned at the lower and upper edges.

Canopy 36 as shown, is formed in one embodiment of relatively flat members which, when cooperatively positioned, define a closed funnel-like arrangement. However, canopy 36 can likewise be formed of curved segements whereby to form a substantially spherical arrangement. In either instance the upper end of the canopy is provided with an opening at ring 45 into which the effluent from the freely flowing well 26 is received. Said opening is formed with means to engage conduit 29 whether the latter be rigid or of flexible construction.

In the instance of a rigid conduit 29, the latter is of relatively wide diameter to receive not only the upward flowing crude oil but also the gases which have been released, and which will expand in the water to bubble and cause severe turbulence.

Operationally, in the present arrangement the tension leg platform 10 will, as herein noted, achieve its drilling function by way of riser 23 and well head 21. In the event well 26 becomes uncontrollable due to excessive pressure, a breakdown of equipment, or for any other reason, the riser will be detached from the well head and retrieved onto the platform 10.

Thereafter, the platform's buoyancy is adjusted to raise it higher in the water such that the canopy segments 39 can be positioned on submergible hull 31. Preferably this assembly operation can be achieved above the water. However, depending on the weight of platform 10, the submergible hull 31 might be disposed underwater with the necessity that the canopy be installed at least partially by divers.

In any event, with hull 31 equipped with canopy 36, the lower end of conduit 23 is attached to the canopy upper opening at 41. The submergible hull is now slidably engaged with the respective hold down cables 17.

Although submergible hull 31 is provided with controlled buoyancy tanks, the hull is preferably lowered to the ocean floor by a cable pull down system. The latter is comprised of a separate pull down cable integral with cable assembly 17, and which is connected at one end to the submergible vessel 31. It extends downwardly through a positioning anchor 24 and thence through a pulley arrangement 28. The pull down cable is then led upwardly through the corner member 33 of hull 31, to winch 19 on platform 10.

Thus, in spite of the turbulence which is created at the water's surface, and through the water by rapidly rising and expanding gas bubbles, the entire submergible hull can be forcibly drawn downward. This is achieved by uniformly tensioning all the pull down cables 17 such that the hull will be maintained in a relatively vertical disposition despite its buoyed tendency, and consequently avoid the possibility of becoming tilted as to bind on one or more of the hold down cables.

As the hull 31 is preogressively pulled toward the ocean floor, by adding sections thereto conduit 23 will be lengthened.

Where a non-rigid conduit 29 is utilized, the latter in one embodiment can be comprised of an elongated member which is sufficiently flexible to be compressed about opening 41 at the canopy top. Thereafter, as the hull is lowered, the conduit 29 can be drawn from its compressed condition with the upper opening being retained at the surface and connected to separating equipment which will receive the effluent from the freely flowing well.

As the submergible hull 31 approaches well head 21, more and more of the rising effluent will be received therein and conducted to the water's surface. Thus, it is unnecessary for the hull to be brought all the way to the ocean floor. It can be suspended a distance above well 26, or above the freely flowing effluent source such that the latter will be conducted into the closure. The rising gas and oil will pass upward through the conduit 29 to the separating equipment at the water's surface.

As noted, the water adjacent to and above well 20 will be in a state of turbulence due to expanding gas. In like manner, upwardly flowing fluid within the conduit will feel the internal effects of expanding gases as well as external water pressure. To stabilize conduit 29, the latter can be provided at vertical intervals with a series of braces which lean against cables 17 for support.

While the freely flowing hydrocarbons are thus being collected and retained, necessary steps can be taken to either plug well 26 or to in other ways regulate the uncontolled flowing by a diversion well or other means. In any event, submergible hull 31 will be retained in place until the flow therefrom has been stemmed. Thereafter, the hull can be raised from its ocean floor position by the respective pull down cables 17 and by the hull's internal buoyancy.

At the water's surface, canopy segments 39 will be removed from hull 31 and vessel 10 will again be in condition to commence a new drilling operation, or to continue on the present well.

Other modifications and variations of the invention as hereinbefore set forth can be made without departing from the spirit and scope thereof, and therefore, only such limitations should be imposed as are indicated in the appended claims.

I claim:

1. A tension leg platform system for use in an offshore body of water to drill wellbores into the ocean floor, and for confining an uncontrolled flow of effluent issuing from an opening at the ocean floor, and which system includes;

a semi-submersible marine vessel holding wellbore drilling equipment, a plurality of positioning anchors resting on the ocean floor and disposed about said opening, cable means extending between said semi-submersible marine vessel and said respective positioning anchors, and being adjustable to vary the cable tension whereby to draw the said vessel to a predetermined water depth, a submergible hull defining a vertical passage therethrough and being adapted to operably engage the respective cable means, a canopy removably positioned on said submergible hull to form a substantial closure across said vertical passage, whereby said submersible hull can be guidably pulled down along said respective cable means, and located above said opening which is emitting the uncontrolled effluent flow to thereby receive said effluent flow within said canopy forming said enclosure.

2. In the apparatus as defined in claim 1, wherein said opening includes; a well head, and said vertical passage in said submergible hull is sufficiently large to surround said well head.

3. In the apparatus as defined in claim 1, wherein said submergible hull includes; controlled buoyancy means therein.

4. In the apparatus as defined in claim 1, wherein said submergible hull includes; means to removably engage the marine vessel whereby the hull can be detached from the vessel prior to the hull being pulled down along said cable means.

5. In the apparatus as defined in claim 1, wherein said semi-submersible marine vessel includes; winch means adapted to engage said cable means and being operable to apply a desired tension to the latter thereby drawing said marine vessel downwardly into the predetermined water depth.

6. In the apparatus as defined in claim 1, wherein said canopy includes; a plurality of discrete canopy segments being movably engaged with said hull to form the substantial enclosure across said vertical passage.

7. In the apparatus as defined in claim 1, including buoyancy control means carried on said submersible hull and being operable from said marine vessel to regulate the disposition of said hull as the latter is lowered through the water.

8. In the apparatus as defined in claim 1, including; a conduit communicated with said canopy and being extendable to the water's surface to conduct said flow of effluent from said opening, to the latter.

9. In the apparatus as defined in claim 8, wherein said conduit comprises a rigid, cylindrical member.

10. In the apparatus as defined in claim 8, wherein said conduit is formed of a flexible material, and is extendable to reach between the canopy and the water's surface.

11. In the apparatus as defined in claim 8, wherein said conduit is formed of a flexible material and is extendable to reach between the canopy and the water's surface when the submersible hull is positioned at the said opening.

12. In an apparatus as defined in claim 1, wherein said marine vessel includes; a deck, and a plurality of upstanding controlled buoyancy legs depending from said deck, said submergible hull being removably positioned beneath the respective legs to engage said hold down cable means and thereby permit the hull to be pulled downward toward the opening.

* * * * *